US010117561B2

(12) United States Patent
Kan et al.

(10) Patent No.: US 10,117,561 B2
(45) Date of Patent: Nov. 6, 2018

(54) DISHWASHER COMPRISING A CLEANING SYSTEM FOR A LIQUID/GEL DETERGENT DOSING UNIT AND A RECEPTACLE UNIT

(71) Applicant: ARCELIK ANONIM SIRKETI, Istanbul (TR)

(72) Inventors: Ugur Kan, Istanbul (TR); Orhan Atabey, Istanbul (TR); Mehmet Diksan, Istanbul (TR); Mete Unlusoy, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 63 days.

(21) Appl. No.: 14/904,072

(22) PCT Filed: Jun. 27, 2014

(86) PCT No.: PCT/EP2014/063631
§ 371 (c)(1),
(2) Date: Jan. 8, 2016

(87) PCT Pub. No.: WO2015/003922
PCT Pub. Date: Jan. 15, 2015

(65) Prior Publication Data

US 2016/0143503 A1 May 26, 2016

(30) Foreign Application Priority Data

Jul. 8, 2013 (TR) ..... a 2013 08198

(51) Int. Cl.
*A47L 15/44* (2006.01)
*A47L 15/00* (2006.01)

(52) U.S. Cl.
CPC ..... *A47L 15/0055* (2013.01); *A47L 15/449* (2013.01); *A47L 15/4418* (2013.01); *A47L 15/4436* (2013.01); *A47L 15/4463* (2013.01)

(58) Field of Classification Search
CPC ..... A47L 15/0055; A47L 15/0057; A47L 15/4276; A47L 15/44; A47L 15/4418;
(Continued)

(56) References Cited

U.S. PATENT DOCUMENTS 1,615,413 A * 1/1927 Snyder ..... D06F 39/022 68/17 R
1,825,584 A * 9/1931 Donley ..... D06F 13/00 34/191
(Continued)

FOREIGN PATENT DOCUMENTS

DE 4000378 A1 7/1991
DE 20311432 U1 12/2003
(Continued)

OTHER PUBLICATIONS

International Search Report for International Appl. No. PCT/EP2014/063631.
(Continued)

*Primary Examiner* — David G Cormier
(74) *Attorney, Agent, or Firm* — Kilpatrick Townsend & Stockton LLP

(57) ABSTRACT

The present invention relates to dishwasher (100) comprising a dosing unit (4) that can adjust the required amount of detergent as per the selected program type and dose into the washing cabin (1), and a cleaning system (9) that implements a detergent washing cycle enabling the detergent residues left in the detergent receptacle (2) from the previous use to be washed and enables the detergent receptacle (2) and the dosing mechanism (3) to be washed.

10 Claims, 6 Drawing Sheets

Figure 1:
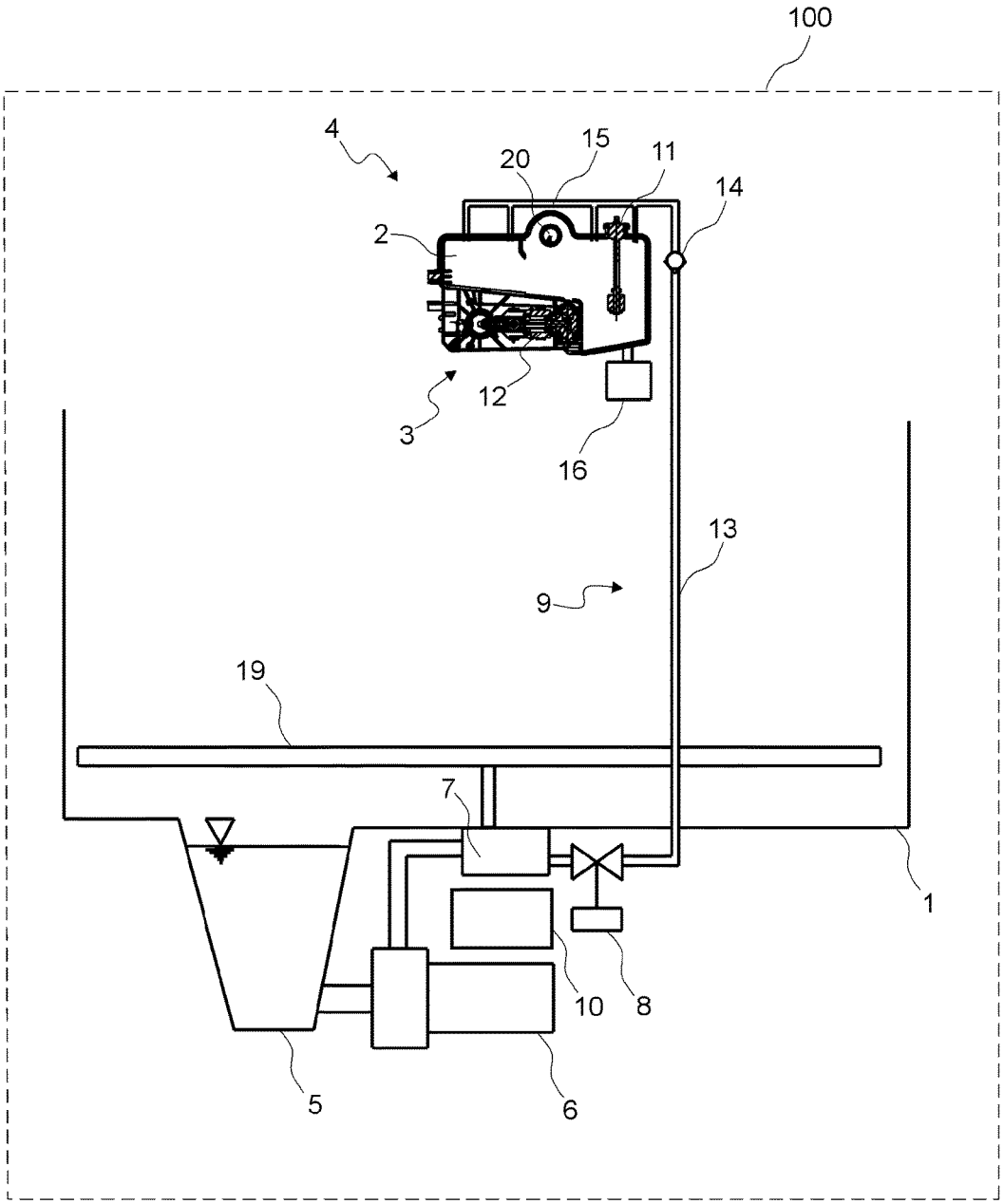

(58) Field of Classification Search
CPC ..... A47L 15/4427; A47L 15/4463; A47L 15/449; A47L 15/4214; A47L 15/4219; A47L 15/4221; A47L 15/4225
See application file for complete search history.

(56) References Cited

U.S. PATENT DOCUMENTS

| | | | | |
|---|---|---|---|---|
| 4,090,475 | A | 5/1978 | Kwan | |
| 4,756,321 | A * | 7/1988 | Livingston | A47L 15/0055 134/56 D |
| 2003/0051296 | A1* | 3/2003 | Broker | D06F 33/02 8/158 |
| 2004/0244434 | A1* | 12/2004 | Zucholl | A47L 15/4409 68/12.16 |
| 2005/0126607 | A1* | 6/2005 | Haft | A47L 15/44 134/56 D |
| 2005/0133070 | A1* | 6/2005 | Vanderroest | A47L 15/16 134/56 D |
| 2005/0183208 | A1* | 8/2005 | Scheper | D06F 25/00 8/142 |
| 2009/0095750 | A1 | 4/2009 | Vitan et al. | |
| 2009/0194562 | A1 | 8/2009 | Kessler et al. | |
| 2010/0139328 | A1 | 6/2010 | Favaro | |
| 2010/0199724 | A1 | 8/2010 | Schulze | |
| 2011/0154864 | A1 | 6/2011 | Schulze | |
| 2011/0174345 | A1* | 7/2011 | Carrer | A47L 15/0049 134/115 R |
| 2011/0185773 | A1 | 8/2011 | D'Andrea et al. | |

FOREIGN PATENT DOCUMENTS

| | | | |
|---|---|---|---|
| DE | 102007032759 | A1 | 1/2009 |
| DE | 102007037883 | A1 | 2/2009 |
| EP | 2011913 | A1 | 1/2009 |
| EP | 2311264 | A2 | 4/2011 |
| EP | 2311364 | A2 | 4/2011 |
| WO | 201013101 | A1 | 2/2010 |
| WO | 2010070024 | A1 | 6/2010 |

OTHER PUBLICATIONS

Written Opinion of International Searching Authority for International Appl. No. PCT/EP2014/063631.
Office Action dated May 18, 2017, of European Application No. 14733630.9; 3 pgs.

* cited by examiner

DISHWASHER COMPRISING A CLEANING SYSTEM FOR A LIQUID/GEL DETERGENT DOSING UNIT AND A RECEPTACLE UNIT

The present invention relates to a dishwasher comprising a cleaning system for a receptacle unit and an automatic liquid/gel dosing unit that is stationary or can be detached/attached by the user and that can adjust the required amount of detergent for the selected program type and dose into the washing cabin.

In dishwashers, the amount of detergent as described in the user manual and according to the amount of the load placed therein must be placed into the detergent dispenser by the user before the washing program is started. In these embodiments, the consumers are observed to use lesser or greater amounts of detergent depending on their habit of use. Using different amounts of detergent can cause unclean washing or untimely corrosion of the dishes. In order to eliminate these problems, in addition to the present detergent dispenser providing use of powder or tablet detergent, a unit has been designed that can automatically dose the desired amount of liquid- or gel-type detergent into the wash water of the machine depending on the washing program. With the intended design, it is possible to correctly deliver the detergent in the amount of usage as described in the user manual into the wash water of the dishwasher at the right time. Again by means of the same unit, it is possible to detect the amount of load placed into the dishwasher with appropriate sensors and calculate the amount of detergent in accordance with the detected load amount and deliver it to the washing program at the right time.

There are various liquid/gel detergents having many different features that are produced to be suitable for dishwashers. The fluidity characteristics of these detergents may change under normal environment conditions due to their ingredients. The fluidity characteristics of these detergents may change and these detergents may even solidify particularly when they stay in continuous contact with water and air. Moreover, when detergents of different brands or having different characteristics are mixed, the detergents may affect one another and may solidify inside the storage container. Although the user does not mix two different types of detergents, the detergent residues from the previous use in the storage container may interact with the different type of detergent added into the storage container and may cause the fluidity of the detergent in the container to change and even to solidify.

In the state of the art German Patent Application No. DE 40 00 378 A1, a washer is explained that can transfer liquid detergent from a liquid detergent tank into the dosing chamber and that flushes the detergent delivered during the washing cycle from the dosing chamber into the washing tub with the wash water.

The aim of the present invention is the realization of a dishwasher that enables the liquid/gel residues in the detergent receptacle and the dosing mechanism to be completely cleaned, that prevents functional malfunctions that may occur due to liquid/gel detergent residues and that allows the liquid/gel detergent dosing function to be performed always with the same precision and safety.

The dishwasher realized in order to attain the aim of the present invention and explicated in the attached claims, comprises a washing cabin; a dosing unit having a detergent receptacle wherein liquid/gel detergent can be filled and a dosing mechanism that can dose the required amount of liquid/gel detergent as per the selected program from the detergent receptacle into the washing cabin; a liquid/gel detergent dosing unit cleaning system (referred to as the cleaning system hereinafter) that enables the detergent residues left in the detergent receptacle from the previous use to be washed, enabling one or more than one detergent washing cycle to be implemented, pumping the clean water from the water mains or the wash water from a sump disposed at the bottom of the washing cabin by means of a circulation pump and through one or more than one valve to the detergent receptacle and enabling the detergent receptacle and the dosing mechanism to be washed and cleaned; a detergent level sensor that is disposed in the dosing unit, that detects the detergent level in the detergent receptacle and enables the level signal to be delivered to the control unit; and a control unit that provides the controlling of the cleaning system and the dosing unit, that determines whether or not the dosing unit is suitable for use depending on the detergent level signal received from the detergent level sensor and that starts the detergent washing cycle by activating the cleaning system depending on detergent level signal of the detergent level sensor.

The designed dosing unit cleaning system enables the detergent receptacle and the dosing mechanism to be washed and cleaned in the condition the liquid/gel detergent in the detergent receptacle is depleted or is not sufficient for the selected program type. The wash water or clean water pumped into the detergent receptacle is redirected again to the wash water sump with a syringe in the dosing mechanism. Thus, both the receptacle and the part of the syringe opening into the receptacle and the interior of the syringe can be cleaned. The cleaning system can also discharge the water in the receptacle into the wash water sump with the effect of gravity through an electrically, magnetically or mechanically controlled discharge valve without requiring the use of the syringe. Both the syringe and the discharge valve can be used together for discharging the water collected in the receptacle. Thus, the cleaning process is enabled to performed quickly. In the detergent washing cycle, depending on the washing step being implemented, the present wash water can be used or clean water can be taken. The receptacle wash water is heated, thereby the receptacle washing process is realized more efficiently and in a shorter period of time. The detergent washing cycle performed with cold or hot water can be repeated once or more than once depending on cleaning of the receptacle. The number of detergent washing cycle repeats can change depending on the time elapsed since the last washing of the receptacle. At the end of each detergent washing cycle, water can be discharged and new clean water can be delivered. Heating can be performed at each cycle or heating is not performed depending on the cleanliness of the receptacle. In order to clean the inner surface of the storage more efficiently, the wash water or clean water can be filled into the receptacle by being sprayed through a pipe from below or the nozzles from above under pressure. The water in the detergent receptacle can be discharged into the wash water sump with the effect of gravity by using the detergent dosing mechanism and/or the discharge valve in the cleaning system or the pipe opening to the underside of the detergent receptacle.

The detergent receptacle used in the dishwasher of the present invention, is stationary depending on the design or can be detached/attached by the user. The dishwasher comprises a dosing unit that can be detached/attached by the consumer and a control unit that enables the consumer to be warned via the control panel to detach and wash the detergent receptacle depending on the signal of the detergent level sensor and that does not operate the liquid/gel detergent dosing unit until the detergent receptacle is detached and attached again.

The user is warned to detach, wash and fill the receptacle via the control panel after the detergent depleted signal is delivered to the control unit. When liquid detergent is to be filled, it is not possible to operate the detergent dosing unit until the receptacle is detached and attached again and provided that a predetermined time duration elapses between detachment and attachment. In designs wherein the detergent receptacle can be detached and attached again by the consumer, the receptacle cleaning system described above is not required to be used. Since the syringe and the detergent receptacle are designed as an integrated unit, when the user detaches and washes the receptacle, the syringe barrel is also cleaned of detergent residues.

Thus, the washed detergent receptacle and the syringe become ready for the next use of the detergent dosing unit and the liquid/gel detergent dosing mechanism is prevented from clogged and furthermore the detergent filled into the detergent receptacle is prevented from solidifying.

The model embodiments relating to the dishwasher realized in order to attain the aim of the present invention are illustrated in the attached figures, where:

FIG. 1—is the schematic view of a detergent receptacle cleaning system.

Figure 2:
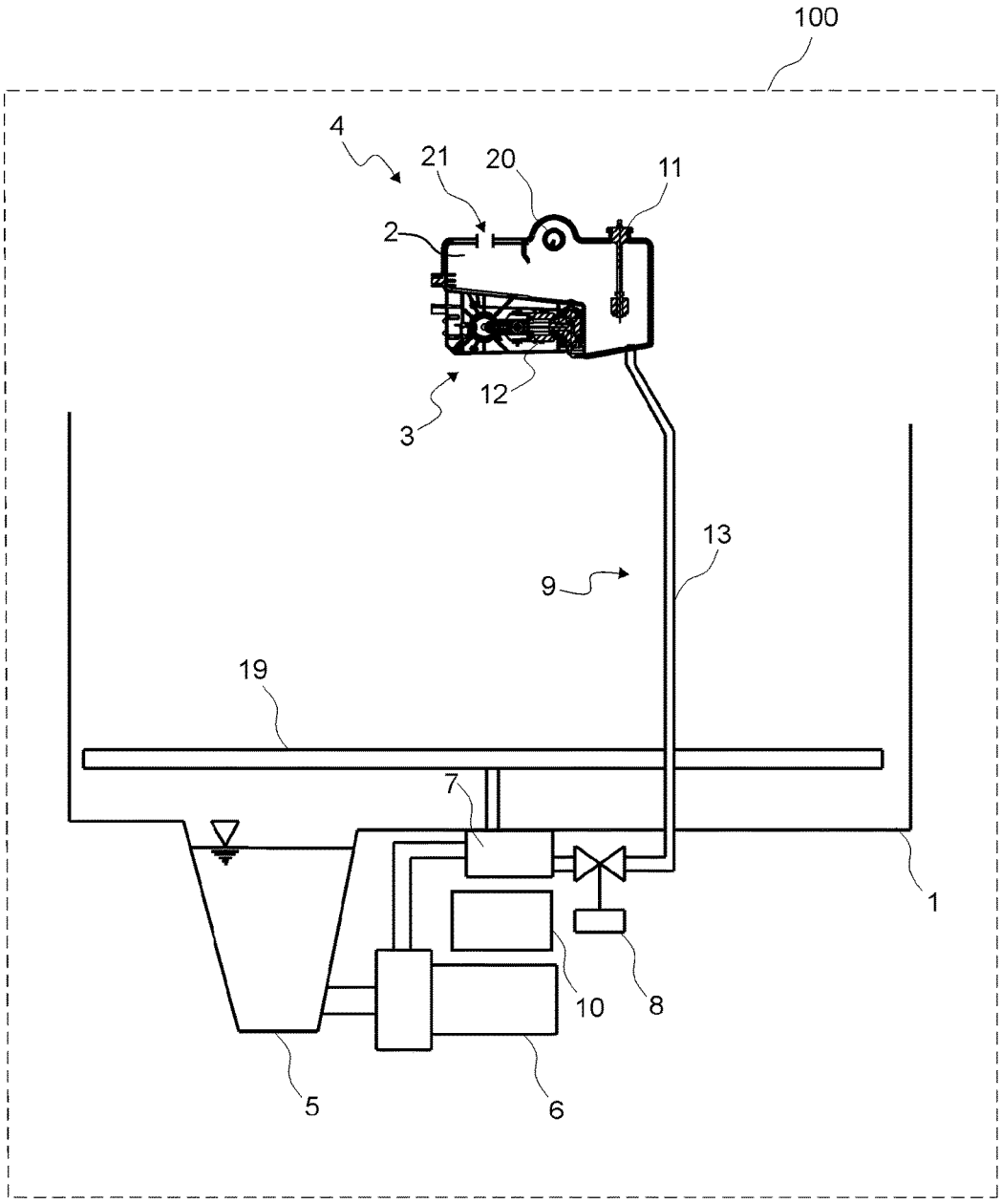

FIG. 2—is the schematic view of a detergent receptacle cleaning system in an embodiment of the present invention.

Figure 3:
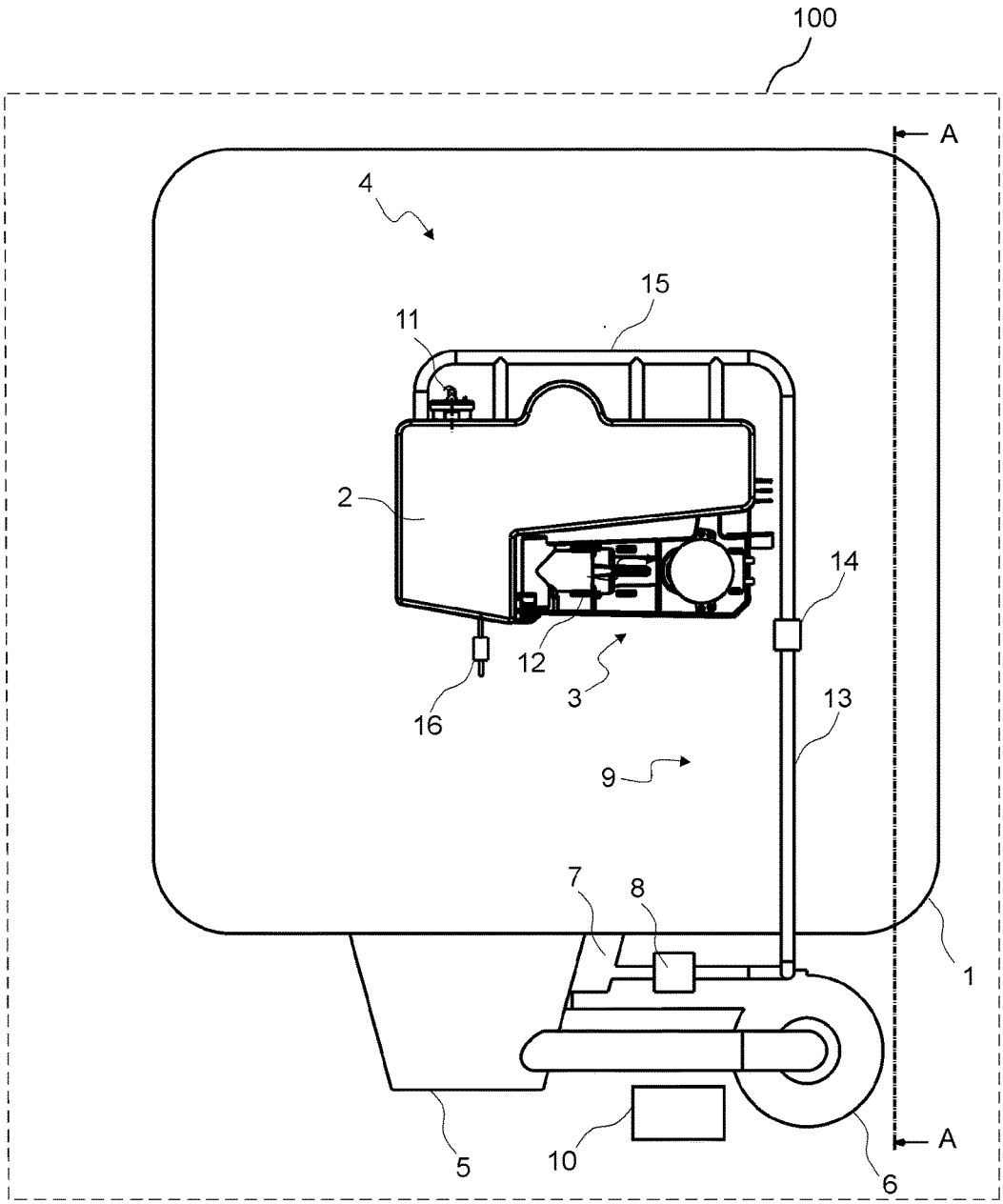

FIG. 3—is the schematic view of a detergent receptacle cleaning system in another embodiment of the present invention.

Figure 4:
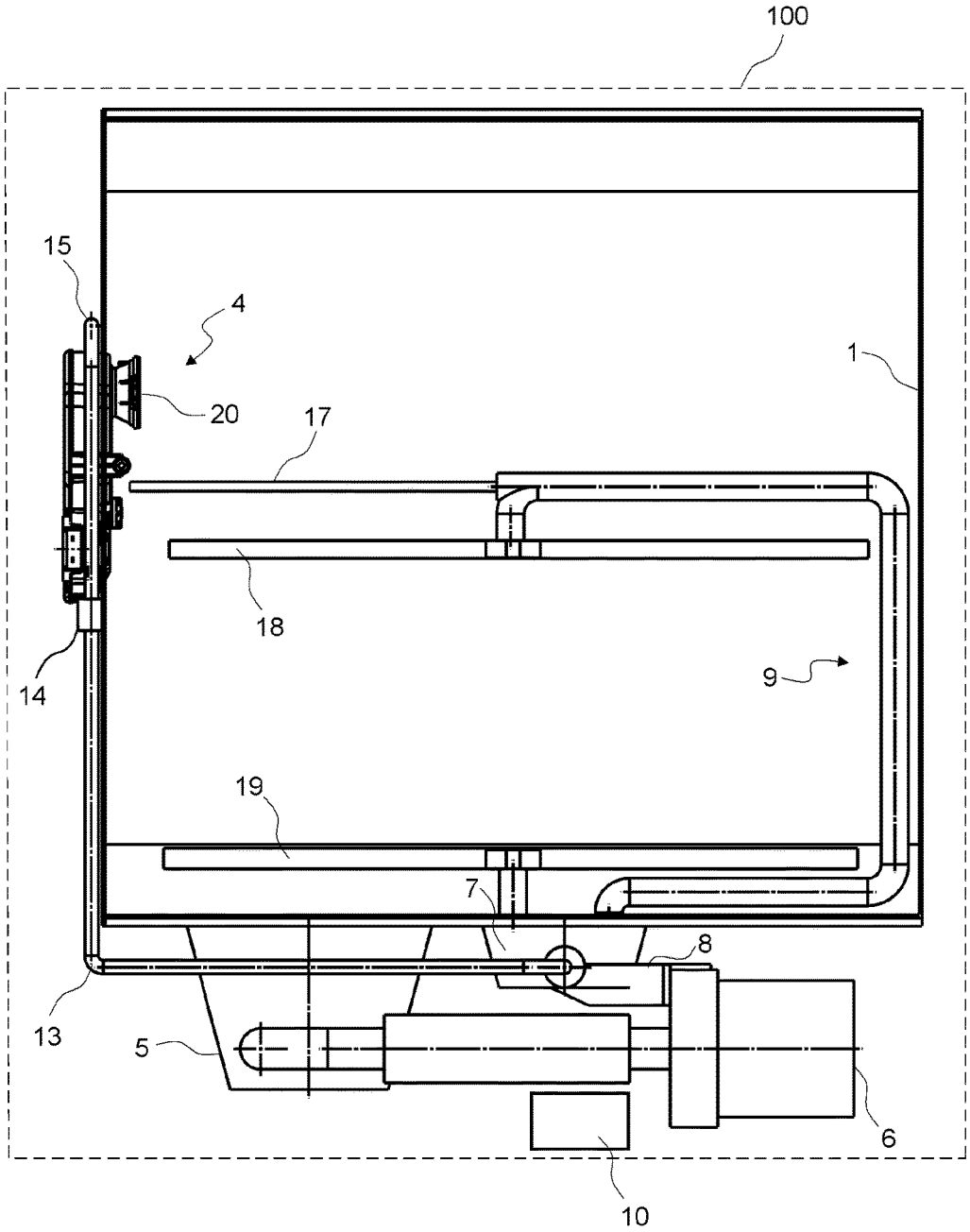

FIG. 4—is the view of cross-section A-A in FIG. 3.

Figure 5:
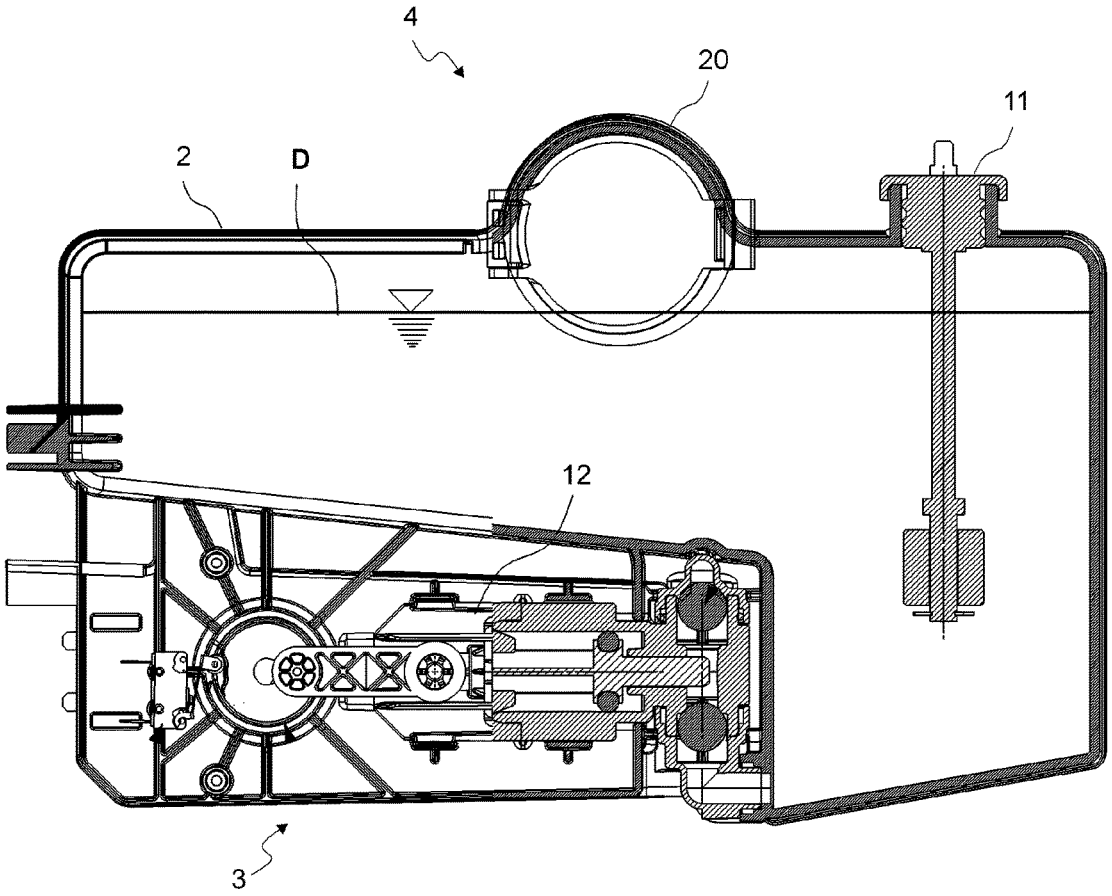

FIG. 5—is the cross-sectional view of a detergent receptacle and a dosing unit.

Figure 6:
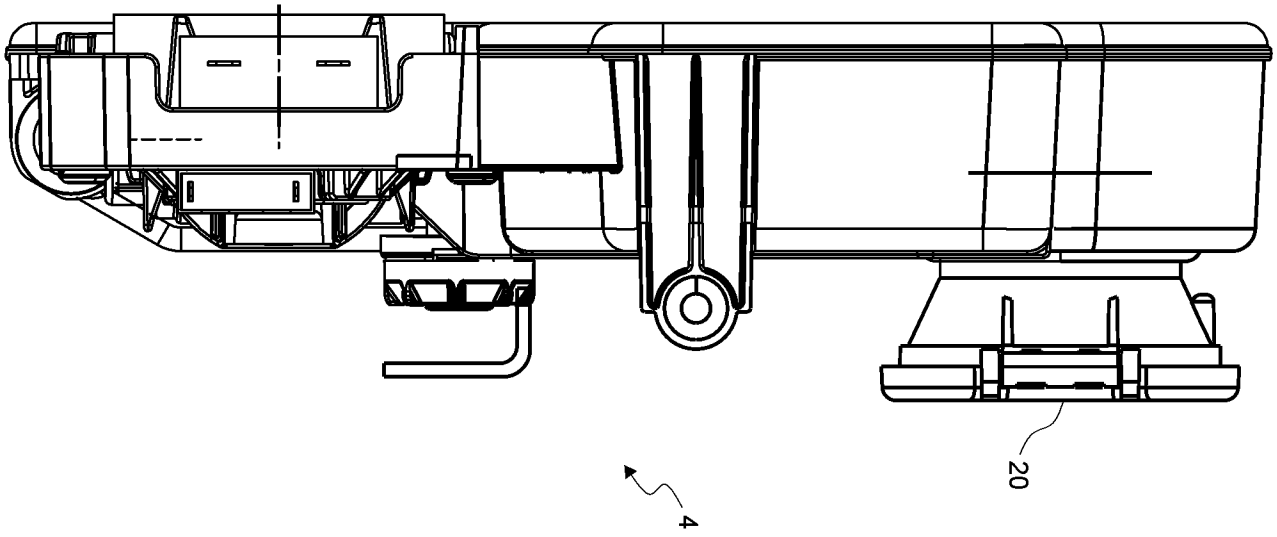

FIG. 6—is the sideways view of a detergent receptacle and a dosing unit.

The elements illustrated in the figures are numbered as follows:

1. Washing cabin
2. Detergent receptacle
3. Dosing mechanism
4. Dosing unit
5. Sump
6. Circulation pump
7. First valve
8. Second valve
9. Cleaning system
10. Control unit
11. Detergent level sensor
12. Syringe mechanism
13. First pipe
14. Check valve
15. Detergent receptacle washing nozzles and ducts
16. Discharge valve
17. Second pipe
18. Upper spray arm
19. Lower spray arm
20. Cover
21. Air inlet opening
100. Dishwasher The dishwasher (100) comprises a washing cabin (1), a dosing unit (4) having a detergent receptacle (2) wherein liquid/gel detergent (D) can be filled and a dosing mechanism (3) that can dose the required amount of liquid/gel detergent (D) as per the selected program from the detergent receptacle (2) into the washing cabin (1), a liquid/gel detergent dosing unit cleaning system (9) (referred to as the cleaning system hereinafter) that implements one or more than one detergent washing cycle enabling the detergent residues left in the detergent receptacle (2) from the previous use to be washed, and that enables the detergent receptacle (2) and the dosing mechanism (3) to be washed and cleaned by pumping the clean water from the water mains or the wash water from a sump (5) disposed at the bottom of the washing cabin (1) by means of a circulation pump (6) and through one or more than one valve (7, 8) to the detergent receptacle (2), a detergent level sensor (11) that is disposed in the dosing unit (4), that detects the liquid/gel detergent (D) level in the detergent receptacle (2) and generates signals relating to the detergent level and a control unit (10) that provides the controlling of the cleaning system (9) and the dosing unit (4), that determines whether or not the dosing unit (4) is suitable for use depending on the detergent level signal received from the detergent level sensor (11) and that starts the detergent washing cycle by activating the cleaning system (9) depending on detergent level signal of the detergent level sensor (11) (FIG. 1 to FIG. 6).

In an embodiment of the present invention, the control unit (10)

operates a syringe mechanism (12) disposed in the dosing mechanism (3) and enables the water in the detergent receptacle (2) to be discharged again to the washing cabin (1) or the sump (5) in order to prevent the water directed to the detergent receptacle (2) from accumulating.

In an embodiment of the present invention, the dishwasher (100) comprises a control panel (not shown in the figures) whereon a display is situated. The control unit (10) enables that the user is warned by the liquid/gel detergent (D) depleted warning via the control panel after the liquid/gel detergent (D) depleted signal of the detergent level sensor (11), the consumer is warned to fill the detergent receptacle (2) via the control panel in the next operation due to the detergent receptacle (2) being empty or not containing sufficient amount of detergent, the dishwasher (100) is operated via the control panel as per the selection of the consumer and the detergent washing cycle is started in any one of the washing steps following the liquid/gel detergent (D) depleted signal before the liquid/gel detergent is filled.

The detergent receptacle (2) has a cover (20) enabling the liquid/gel detergent (D) to be filled therein. In an embodiment of the present invention, the cover (20) of the detergent receptacle (2) can be locked automatically until the detergent washing cycle is finished. The lock is opened by the control unit (10) when the liquid/gel detergent (D) is to be filled. The consumer is warned to perform filling.

In an embodiment of the present invention, the control unit (10) enables that the detergent washing cycle is started at the end of the main washing step following the liquid/gel detergent (D) depleted signal.

In an embodiment of the present invention, the control unit (10) enables that the present wash water is used or clean water to be taken and used in the detergent washing cycle depending on the washing step being implemented.

In an embodiment of the present invention, the dishwasher (100) comprises a heating unit that is not shown in the figures. In this embodiment of the present invention, the control unit (10) enables that the detergent receptacle (2) and the dosing mechanism (3) are washed and cleaned in a shorter period of time by heating the wash water by means of the heating unit in the detergent washing cycle.

The hot water can be received from the water mains but also the cold water received from the mains can be heated inside the dishwasher (100).

In an embodiment of the present invention, the control unit (10) enables that the detergent washing cycle is repeated more than once with cold or hot water depending on the cleanliness of the detergent receptacle (2).

In an embodiment of the present invention, the cleanliness of the detergent receptacle (2) is determined according to the time elapsed after the last washing.

In another embodiment of the present invention, the cleanliness of the detergent receptacle (2) is determined by a viscosity sensor, not shown in the figures, depending on the viscosity of the water in the detergent receptacle (2) during the detergent washing cycle.

In an embodiment of the present invention, the control unit (10) enables that the wash water is discharged at the end of each detergent washing cycle and clean water is taken, and furthermore the water is preferably heated at each detergent washing cycle depending on the cleanliness of the detergent receptacle (2).

In an embodiment of the present invention, the cleaning system (9) comprises a circulation pump (6), a first valve (7) directing the wash water, a second valve (8) directing the detergent washing water, a first pipe (13) that delivers the wash water to the detergent receptacle (2), a check valve (14), detergent receptacle washing nozzles and ducts (15) and a discharge valve (16) (FIG. 1).

In an embodiment of the present invention, the detergent receptacle washing nozzles and ducts (15) open to the upper side of the detergent receptacle (2). Thus, the wash water is sprayed under pressure into the detergent receptacle (2) from the upper side and the base and side walls of the detergent receptacle (2) are washed effectively.

In this embodiment of the present invention, the control unit (10) enables that the water in the sump (5) is directed to the detergent receptacle (2) via the circulation pump (6), the first valve (7), the second valve (8), the first pipe (13), the check valve (14) and the detergent receptacle washing nozzles and ducts (15), and the circulation pump (6) is stopped for discharging the wash water collected in the detergent receptacle (2) and the water collected in the detergent receptacle (2) is directed again to the sump (5) via the discharge valve (16). In the meantime, the dosing unit (4) is cleaned by operating the dosing mechanism (3).

In an embodiment of the present invention, the water pumped into the detergent receptacle (2) can be discharged by using the present dosing mechanism (3) without requiring the discharge valve (16).

In an embodiment of the present invention, the detergent receptacle (2) is washed without requiring the check valve (14), the detergent receptacle washing nozzles and ducts (15) and the discharge valve (16). In this embodiment of the present invention, the cleaning system (9) comprises the first pipe (13) that opens to the lower side of the detergent receptacle (2) (FIG. 2). Accordingly, it becomes possible to use the first pipe (13) in order to discharge the detergent receptacle (2).

In an embodiment of the present invention, the dishwasher (100) comprises an air inlet opening (21) that is arranged on the detergent receptacle (2) and that enables the water in the detergent receptacle (2) to be discharged easily at the end of the washing by balancing the pressure.

In this embodiment of the present invention, the control unit (10) enables that the water in the sump (5) is directed to the detergent receptacle (2) via the circulation pump (6), the first valve (7), the second valve (8) and the first pipe (13) and the circulation pump (6) is stopped for discharging the water collected in the detergent receptacle (2), the outlet of the first valve (7) and/or the second valve (8) is kept open and the wash water in the detergent receptacle (2) is discharged on its own with the effect of gravity through the first pipe (13). In the meantime, the dosing mechanism (3) is also operated and thus the dosing unit (4) is cleaned. The air inlet opening (21) facilitates the water discharging process.

In an embodiment of the present invention, the cleaning system (9) comprises a second pipe (17) connected to the line that delivers water to an upper spray arm (18) or an lower spray arm (19) enabling water to be sprayed into the washing cabin (1) (FIG. 3 and FIG. 4). In this embodiment of the present invention, the control unit (10) enables that the water in the sump (5) is directed to the detergent receptacle (2) via the circulation pump (6), the first valve (7), the second valve (8), the check valve (14) and the second pipe (17) and the circulation pump (6) is stopped for discharging the wash water collected in the detergent receptacle (2) and the water collected in the detergent receptacle (2) is directed again to the sump (5) by opening the discharge valve (16). In the meantime, the dosing mechanism (3) can also be operated and the dosing unit (4) is cleaned.

In another embodiment of the present invention, the first pipe (13) reaches the detergent receptacle (2) by passing around the exterior of the washing cabin (1). Water is delivered to the detergent receptacle (2) from outside the washing cabin (1) and the first pipe (13) is prevented from occupying space in the washing environment. In the embodiment of the present invention shown in FIG. 4, a second pipe (17) extends through the washing cabin (1) and opens into the detergent receptacle (2).

The detergent receptacle (2) used in the dishwasher (100) can be stationary or can be detached/attached by the consumer depending on the design.

In an embodiment of the present invention, the control unit (10) enables that the consumer is warned to detach and clean the detergent receptacle (2) via the control panel after receiving the detergent depleted signal of the detergent level sensor (11) and the dosing unit (4) is not operated until the detergent receptacle (2) is detached and attached again.

In an embodiment of the present invention, the dishwasher (100) comprises a level float disposed inside the detergent receptacle (2) and a detergent level sensor (11) that detects whether or not the liquid/gel detergent (D) is present in the dosing unit (4) by means of an electro-magnetic sensor depending on the position of the level float. The detergent level signal is transmitted to the control unit (10) through a cable or wirelessly.

In an embodiment of the present invention, the detergent receptacle (2) comprises a cover (20) disposed on the inner door, the side panels (left-right) or the ceiling of the dishwasher (100) where the user can fill detergent from inside or outside of the machine. The detergent receptacle (2) is filled by opening the cover (20).

By means of the present invention a dishwasher (100) is realized, enabling that the liquid/gel detergent (D) residues in the detergent receptacle (2) and the dosing unit (4) are completely cleaned, functional malfunctions that may occur due to liquid/gel detergent (D) residues are prevented and the liquid/gel detergent (D) dosing function is continued with the same precision and safety.

The invention claimed is:

1. A dishwasher, comprising:

a washing cabin;

a dosing unit having a detergent receptacle containing liquid or gel detergent, and having a dosing mechanism that can dose a required amount of the detergent from the detergent receptacle into the washing cabin based on a selected washing program;

a cleaning system that implements a detergent washing cycle in which the cleaning system pumps receptacle washing water through one or more valves to the detergent receptacle by means of a circulation pump, the receptacle washing water being clean water from a water main or dish washing water from a sump disposed at a bottom of the washing cabin, the receptacle washing water that is pumped by the cleaning system providing for washing and cleaning of the detergent receptacle and the dosing mechanism such that detergent residues left in the detergent receptacle are washed away, wherein the cleaning system comprises the circulation pump and a first pipe that delivers the dish washing water to the detergent receptacle, and wherein the one or more valves include a first valve and a second valve, the first valve directing the dish washing water to the second valve, or alternatively to the washing cabin, the second valve directing the receptacle washing water to the detergent receptacle;

a detergent level sensor disposed in the dosing unit that detects a detergent level of the detergent in the detergent receptacle and generates a signal relating to the detergent level; and a control unit that controls the cleaning system and the dosing unit, receives the signal from the detergent level sensor and starts the detergent washing cycle by activating the cleaning system depending on the signal, wherein the control unit enables the dish washing water in the sump to be directed to the detergent receptacle by the circulation pump via the first valve, the second valve, and the first pipe, and wherein the control unit stops the circulation pump for discharging the receptacle washing water collected in the detergent receptacle, keeps an outlet of the first valve or an outlet of the second valve open, and enables the receptacle washing water in the detergent receptacle to be discharged by gravity via the first pipe.

2. The dishwasher as in claim 1, wherein the control unit enables a user to be warned using a detergent depleted warning via a control panel after receiving a detergent depleted signal from the detergent level sensor, wherein the control unit enables the user to be warned to fill the detergent receptacle or to add tablet or powder detergent in a next operation due to the detergent receptacle being empty or not containing an amount of detergent for the selected washing program, wherein the control unit starts the next operation of the dishwasher depending on a selection of the user and an approval of a detergent type, and wherein the control unit starts the detergent washing cycle in a washing step following the detergent depleted signal before the detergent is filled.

3. The dishwasher as in claim 1, wherein the control unit starts the detergent washing cycle at an end of a main washing step following the detergent level sensor delivering a detergent depleted signal to the control unit.

4. The dishwasher as in claim 1, wherein the control unit enables the receptacle washing water pumped by the cleaning system to be the dish washing water in the sump or the clean water depending on a washing step being implemented.

5. The dishwasher as in claim 1, wherein the control unit enables the dish washing water to be heated by actuating a heating unit in the detergent washing cycle, and enables the detergent receptacle and the dosing mechanism to be washed with the dish washing water heated by the heating unit.

6. The dishwasher as in claim 1, wherein the control unit enables the detergent washing cycle to be repeated more than once depending on an elapsed time since a last detergent washing cycle.

7. The dishwasher as in claim 1, wherein the control unit enables the receptacle washing water to be the clean water at an end of each detergent washing cycle.

8. The dishwasher as in claim 1, wherein the control unit enables a syringe mechanism to be operated in the dosing mechanism, and enables the receptacle washing water in the detergent receptacle to be discharged into the washing cabin or the sump in order to prevent the receptacle washing water directed to the detergent receptacle from accumulating during the detergent washing cycle.

9. The dishwasher as in claim 1, wherein the first pipe opens into a lower side of the detergent receptacle.

10. The dishwasher as in claim 1, further comprising an air inlet opening arranged on the detergent receptacle that balances pressure inside and outside of the detergent receptacle to facilitate the receptacle washing water in the detergent receptacle to be discharged.

* * * * *